United States Patent [19]

Teitelman

[11] Patent Number: 4,946,066

[45] Date of Patent: Aug. 7, 1990

[54] PAPER DISPENSING DEVICE

[76] Inventor: Gerry Teitelman, 2026 Oak St. #1, Santa Monica, Calif. 90405

[21] Appl. No.: 468,900

[22] Filed: Jan. 23, 1990

[51] Int. Cl.[5] ..... B65H 3/00

[52] U.S. Cl. ..... 221/210; 221/255; 221/284; 221/312 R; 271/33

[58] Field of Search ..... 221/210, 36, 37, 45, 221/61, 255, 271, 282, 284, 312 R, 312 A, 312 B, 312 C; 271/33; 206/555, 559, 449, 215

[56] References Cited

U.S. PATENT DOCUMENTS

| | | | |
|---|---|---|---|
| 1,205,892 | 11/1916 | Hecht | 221/210 X |
| 1,793,682 | 2/1931 | Dahl | 221/45 X |
| 1,863,240 | 6/1932 | Daniels | 221/284 X |
| 2,284,071 | 5/1942 | Sayles | 221/37 |
| 2,341,794 | 2/1944 | Kliwer | 221/210 X |
| 2,885,112 | 5/1959 | Willat | 221/210 X |

FOREIGN PATENT DOCUMENTS

| | | | |
|---|---|---|---|
| 1353245 | 1/1964 | France | 271/33 |

*Primary Examiner*—Kevin P. Shaver
*Assistant Examiner*—David H. Bollinger
*Attorney, Agent, or Firm*—Poms, Smith, Lande & Rose

[57] ABSTRACT

A paper dispensing device having a one-piece unitary main body with an upper and lower portion having a depression in the upper portion for receiving the operator's finger therein. The body is resilient and, upon downward pressure of the upper portion, the upper portion moves downwardly, then, upon release, returns to its initial position. The depression results in a concave portion on the underside of the upper portion, the concave portion having a paper adhering material adapted to adhere to a piece of paper and pick up the same. A plurality of individual sheets of paper can be disposed on the upper surface of the lower portion, thereby being in a position contactable by the paper adhering material.

8 Claims, 1 Drawing Sheet

PAPER DISPENSING DEVICE

FIELD OF THE INVENTION

The invention relates to paper dispensing devices; and, more particularly, to a device for picking up pieces of paper one at a time.

DESCRIPTION OF THE PRIOR ART

In U.S. Pat. No. 2,885,112 to Willat, there is disclosed a sheet paper dispensing device which is made of cardboard and formed from a blank. The Willat device has a separate flap 43 which is attached to the blank by hinges and is pressed down to pick up individual pieces of paper stacked inside the box. The confines of the box does not allow for papers of a size greater than the inside of the box. The flap relies for its return on the cardboard hinges and can lose its return ability over a period of time. The device of Willat is not durable, is expensive to manufacture, will not work after continued usage and cannot accommodate papers of a size greater than the interior of the box. The cardboard material can get wet and thus the device is destroyed if used in an environment where the operator's hands may be wet.

There is thus a need for a durable paper dispensing device which can be used to pick up pieces of varying sized papers one at a time.

SUMMARY OF THE INVENTION

It is an object of this invention to provide a device which can pick up individual sheets of paper one at a time.

It is a further object of this invention to provide such a device which is of unitary construction having a curved metallic main body portion wherein the main body portion has an upper and lower portion, the upper portion being resiliently connected to the lower portion.

These and other objects are preferably accomplished by providing a paper dispensing device having a one-piece unitary main body with an upper and lower portion having a depression in the upper portion for receiving the operator's finger therein. The body is resilient and, upon downward pressure of the upper portion, the upper portion moves downwardly, then, upon release, returns to its initial position. The depression results in a concave portion on the underside of the upper portion, the concave portion having a paper adhering material adapted to adhere to a piece of paper and pick up the same. A plurality of individual sheets of paper can be disposed on the upper surface of the lower portion, thereby being in a position contactable by the paper adhering material.

DESCRIPTION OF THE PREFERRED EMBODIMENT

Figure 1:
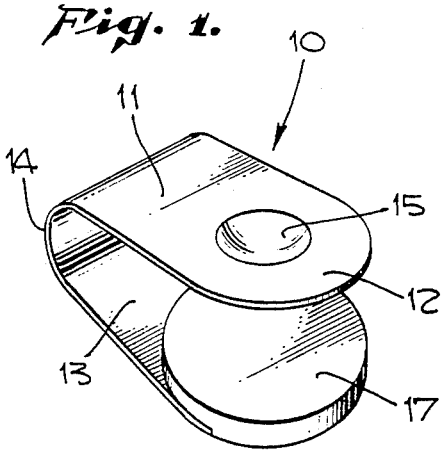
FIG. 1 is a perspective side view of a paper dispensing device in accordance with the invention.

Referring now to FIG. 1 of the drawing, a paper dispensing device 10 is shown having a one-piece main body portion 11 comprised of a unitary piece of resilient material. Any suitable material may be used; however, sheet metal is preferred for durability, ease of manufacture, resiliency and the ability to be flexed from one position to another and return to its initial position.

Figure 2:
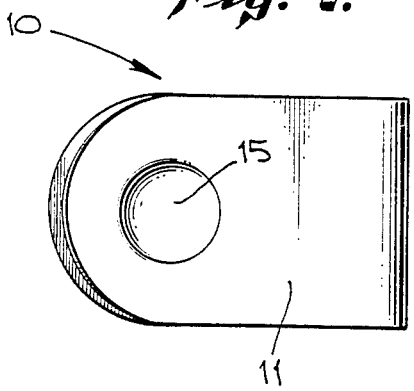
FIG. 2 is a top plan view of the device of FIG. 1.
Figure 3:
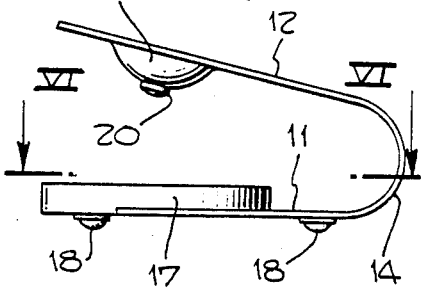
FIG. 3 is a side view of the device of FIG. 1.

Thus, main body portion 11 is preferably a curved piece of metallic material having a top portion 12, a bottom portion 13 and a curved integral interconnecting portion 14. As seen in FIG. 2, a depression 15 is stamped out of top portion 12 resulting in a concave portion 16 (FIG. 3) on the underside of top portion 12.

Figure 4:
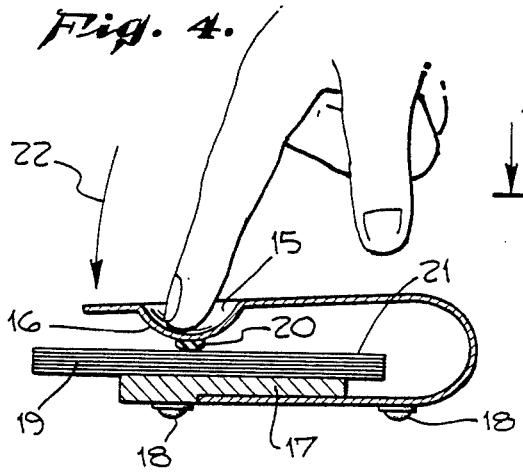
FIG. 4 is a view similar to FIG. 3 illustrating one step in the operation of the device of FIGS. 1–3.

A plate 17 (FIG. 1), which may be round or any suitable configuration, is welded or otherwise secured to bottom portion 13. A plurality of spaced dimples 18 (FIGS. 3–5 and dotted lines in FIG. 6) are provided on the underside of bottom portion 13 and plate 17 to provide feet for device 10. As seen in FIG. 4, a plurality of individual sheets or pieces of paper 19 are loosely disposed on top of plate 17. Finally, a paper adhering material 20, such as butyl rubber, is mounted to the underside of concave portion 16. It is to be understood that any suitable adhering material may be used as long as the same will adhere to concave portion 16, which may be metallic, yet also adhere to a single piece of paper, as sheet 21 (FIG. 5), as will now be discussed.

Figure 5:
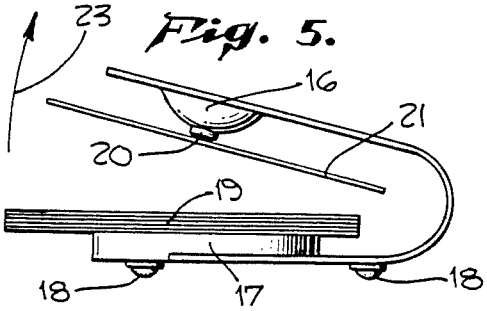
FIG. 5 is a view similar to FIG. 4 illustrating a subsequent step in the operation thereof.
Figure 6:
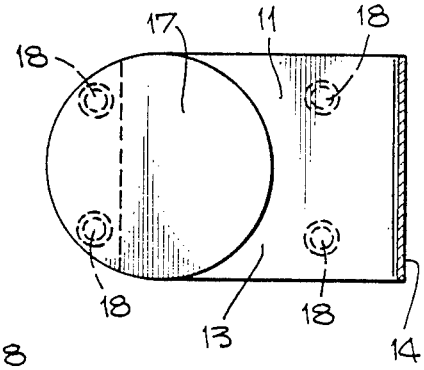
FIG. 6 is a view of the device of FIG. 3 taken along lines VI—VI thereof.

In operation, a piece of adhering material 20 is stuck to concave portion 16. A pile of papers 19 is disposed on top of plate 17 as also seen in FIG. 4. The device 10 is ready to be used to pick up one sheet of paper at a time. Thus, the operator places his or her finger in cavity 15 (FIG. 2) and presses top portion 12 downwardly in the direction of arrow 22 (FIG. 4). When adhering material 20 engages the pile of papers 19, it adheres to the top sheet 21 (FIG. 4). When the operator releases his or her finger, the top portion 12 moves upwardly in the direction of arrow 23 (FIG. 5) back to the position shown in FIG. 5, bringing attached sheet 21 upwardly as seen in FIG. 5. The final position is shown in FIG. 5. The operator can now grasp sheet 21 and easily pull it off of adhering material 20.

The device 10 can be used repeatedly to pick up papers one sheet at a time. If material 20 loses its adhering abilities, another piece of material can be quickly and easily adhered to concave member 16.

Metal can be used throughout, except for material 20 and, as such, is durable. Since main body portion 11 is one piece, it is easy to manufacture and cavity 15 can be quickly and easily punched or stamped out. Since the device 10 is open on the sides, various sized pieces of paper can be used. Any suitable dimensions may be used, depending in part on the size of the pieces of paper or other types of leaf material, such as foil, that one desires to pick up. For example, device 10 may be about 12 inches in overall height, about 2¼ inches in overall width and about 3½ inches in overall length. The plate 17 may also be of metal and fairly heavy, giving stability and steadiness to device 10. It also raises the pieces of paper into a position to be picked up. With the preferred dimensions given above, and the one-piece construction, a short stroke distance and return is provided.

Although butyl rubber is disclosed, any suitable adhering material that securely but removably secures to metal, yet detachably secures to paper or foil, can be used.

We claim:

1. A paper dispensing device comprising:

a unitary sheet of resilient material curving upon itself to form a U-shaped configuration having a top wall and a bottom wall, said walls each having an upper and lower surface and lying in planes generally parallel to each other;

a raised weighted plate fixedly secured to the upper surface of said bottom wall;

a depression in the upper surface of said top wall extending onto the other side or lower surface of said top wall forming a concave protuberance on the lower surface of said top wall extending toward said plate; and paper adhering means removably and fixedly secured to said protuberance adapted to pick up a single piece of paper disposed on top of said plate when said top wall is pushed downwardly.

2. In the device of claim 1 wherein a plurality of spaced feet are provided on the lower surface of said bottom wall.

3. In the device of claim 1 wherein said depression is punched out of the material of said sheet.

4. In the device of claim 1 wherein said adhering means is butyl rubber.

5. In the device of claim 1 wherein said plate is of metallic material.

6. In the device of claim 5 wherein said plate is welded to said bottom wall.

7. In the device of claim 6 including a plurality of spaced support feet on both the undersurface of said plate and the lower surface of said bottom wall.

8. In the device of claim 1 wherein said sheet is of metallic material.

* * * * *